US005646398A

United States Patent [19]

Sieksmeier et al.

[11] Patent Number: 5,646,398

[45] Date of Patent: Jul. 8, 1997

[54] DEVICE FOR COUNTING AND DETERMINING A DIRECTION OF CONVEYED MATERIAL HANGING ON HANGERS PROVIDED WITH HANGER HOOKS

[75] Inventors: Dirk Sieksmeier, Halle; Thomas Blattner, Bielefeld, both of Germany

[73] Assignee: Dürkopp Adler AG, Bielefeld, Germany

[21] Appl. No.: 577,514

[22] Filed: Dec. 22, 1995

[30] Foreign Application Priority Data

Dec. 23, 1994 [DE] Germany ..... 44 46 172.0

[51] Int. Cl.[6] ..... G06M 7/02

[52] U.S. Cl. ..... 250/223 R; 377/6

[58] Field of Search ..... 250/223 R, 224; 377/6, 53

[56] References Cited

U.S. PATENT DOCUMENTS 3,553,465 1/1971 Martin ..... 250/223

4,151,402 4/1979 Fernandez et al. ..... 235/92

4,877,954 10/1989 Neuman et al. ..... 250/222.2

FOREIGN PATENT DOCUMENTS 2922471 5/1980 Germany .

3045657 7/1982 Germany .

3315597 10/1984 Germany .

*Primary Examiner*—Edward P. Westin

*Assistant Examiner*—Alan L. Giles

*Attorney, Agent, or Firm*—Ostrolenk, Faber, Gerb & Soffen, LLP

[57] ABSTRACT

A device for counting the number of and determining the direction of travel of articles being conveyed, particularly articles of clothing, hanging on hangers provided with hanger hooks. Each hanger hook has a stem that is conducted through a light barrier connected with a counting and evaluating unit. The light barrier has at least two receivers that are spaced apart vertically in a plane and consist, in each case, of two sensors which operate independent of each other. The sensors are separated by a small distance. With this device, counting of the hangers is possible regardless of their position and, in particular, erroneous counting due to crossed hangers is excluded.

20 Claims, 5 Drawing Sheets

DEVICE FOR COUNTING AND DETERMINING A DIRECTION OF CONVEYED MATERIAL HANGING ON HANGERS PROVIDED WITH HANGER HOOKS

BACKGROUND OF THE INVENTION

1. Field of the Invention

The present invention relates to a device for counting and determining the direction of conveyed material hanging on hangers provided with hanger hooks, particularly articles of clothing, in which the hanger hooks each have a stem that passes through a light barrier connected to a counting and evaluating unit.

2. Description of the Related Art

Such a device is known from Federal Republic of Germany A-33 15 597. In that counting device, the transmitter and the receiver of the light barrier are arranged above and below the free end of the hook present on the hanger and thus detect the tip of the hook passing by the light barrier.

The known counting device has various disadvantages. For example, the light barrier is directed to the tip of the hook, therefore, the hook of the hanger must have a well-defined shape in order for it to be reliably detected. If the tip of the hook is too short, the hanger is not detected. If the hooks of two hangers hanging one behind the other on the trolley cross each other, and if the point of intersection lies at the tip of the hook, the light barrier detects only one hanger, and an erroneous count results. Oblique hangers can also not be reliably detected by the light barrier and it is not out of the question that a hanger hook which is swinging during counting will lie just outside the beam of light upon passing the light barrier. Also, because the tip of the hanger hook is detected, the loading side of the trolley is dictated by the location of the light barrier.

Federal Republic of Germany A-29 22 471 discloses a human passer-by counting device in which a light barrier is used which has at least two receivers that are spaced apart vertically in a plane and include two round sensors that operate independent of each other. The arrangement of transmitters and receivers disclosed therein assures that the light barrier detects only persons who pass through it and not other forms of life. Furthermore, an indication is given as to the direction of passage. The light barrier must be so installed that, in principle, in all cases only one person can pass through the light barrier. Two people who are walking together alongside or closely behind each other could not be detected by the prior art device as two people. The use of such a known light barrier device for counting continuously conveyed hangers which lie back to back is not possible.

Republic of Germany A-30 45 657 discloses a counting device for counting structural parts fastened spaced apart from each other on a belt. Here, also, only individual structural elements which pass through the light barrier are counted. Structural elements which lie one on top of the other or closely alongside each other cannot be detected as being more than one.

SUMMARY OF THE INVENTION

Accordingly, in view of the problems in the prior art cited above, a counting device is needed that not only counts hangers regardless of their position but, in particular, also eliminates erroneous counting due to hanger hooks that are crossed over each other.

The present invention overcomes the disadvantages in the prior art noted above by providing a light barrier that has two receivers spaced vertically apart in a plane. Each receiver includes two sensors located side by side independently of each other. The sensors are spaced apart from each other in correspondence with the width of the stems of the hangers.

In particular, the spacing is selected such that the stem of the hanger hook which passes through the light barrier definitely covers at least part of both sensors of each receiver during travel through the light barrier.

Preferably, the sum of the horizontal center-to-center spacing plus the diameter or width of the sensors is less than or equal to the width or diameter of the stem of the hanger hook.

As a result of this development, it is possible to detect the stems of the hanger hooks so that the hook shape has no influence on the result of the counting. In this way, differently developed clothes hangers can be used, arranged one behind the other. By the receiver, counting of a variety of styles of hangers is possible, regardless of the direction of conveyance or loading of the hangers.

Further, because the stem of the hanger hook is detected in two different vertical positions by the receiver pairs, crossed hangers can be detected. Accordingly, the receivers preferably are spaced vertically from each other such that the height of the overlapping area of intersection of two hanger hooks is fundamentally smaller than the vertical distance between the receivers. In this way, if one of the receiver detects two crossed hangers as a single hanger, the other of the pair detects two hanger stems. By a suitable electronic evaluation circuit, it is possible to store the higher value during counting so that erroneous counting is reliably prevented.

Preferably only one light transmitter is associated with each receiver. In this way, the cost of manufacture is kept low and the necessary installation space minimized. The light is conducted to the sensors of the receivers preferably via light guides. This has the advantage that optoelectronic components can be integrated into the circuit.

Preferably, four vertically-aligned receivers are provided, as a result of which the reliability of the counting and the accuracy of the result are increased.

Most preferably, the receivers are at a vertical distance from each other of 5 mm. In order to reduce the installation space, the sensors are preferably round, with a diameter of d=1 mm.

In addition, because the receivers each include a pair of sensors according to the present invention, the direction of transport of the article conveyed can be detected by recording the first change in signal, since, depending on the direction of transport, either the first or the second sensor first receives a change in status.

According to a further aspect of the present invention, the device has another light barrier for the detection and counting of carriages bearing the hangers, the further light guide also being connected to the counting and evaluation unit.

Other features and advantages of the present invention will become apparent from the following description of the invention which refers to the accompanying drawings.

BRIEF DESCRIPTION OF THE DRAWINGS

The invention will be described below in further detail with reference to the drawings, in which.

DETAILED DESCRIPTION OF EMBODIMENTS OF THE INVENTION

Figure 1:
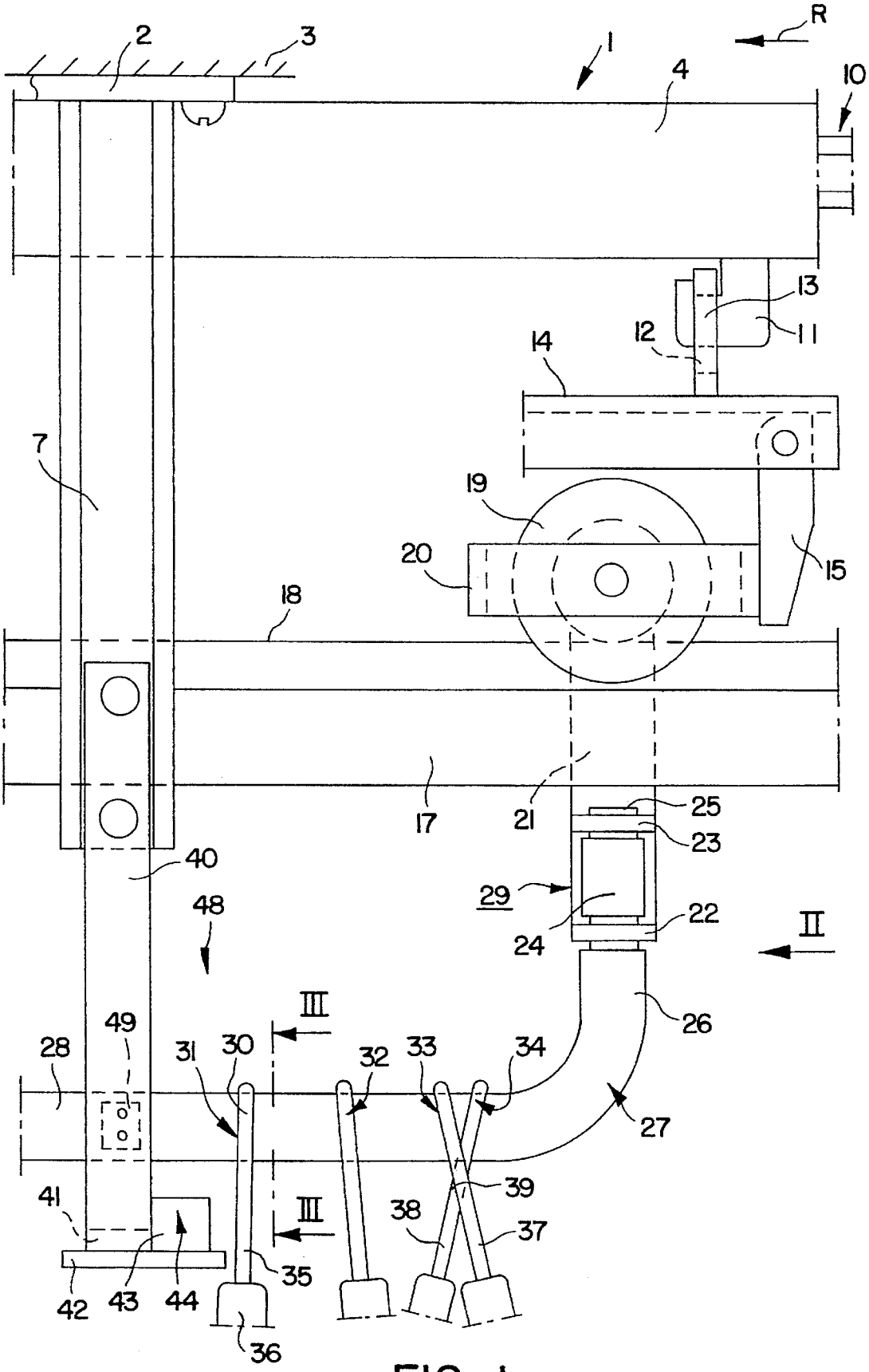
FIG. 1 shows a portion of a hanging conveyor in a front view with a hanger counting device according to a preferred embodiment of the present invention.
Figure 2:
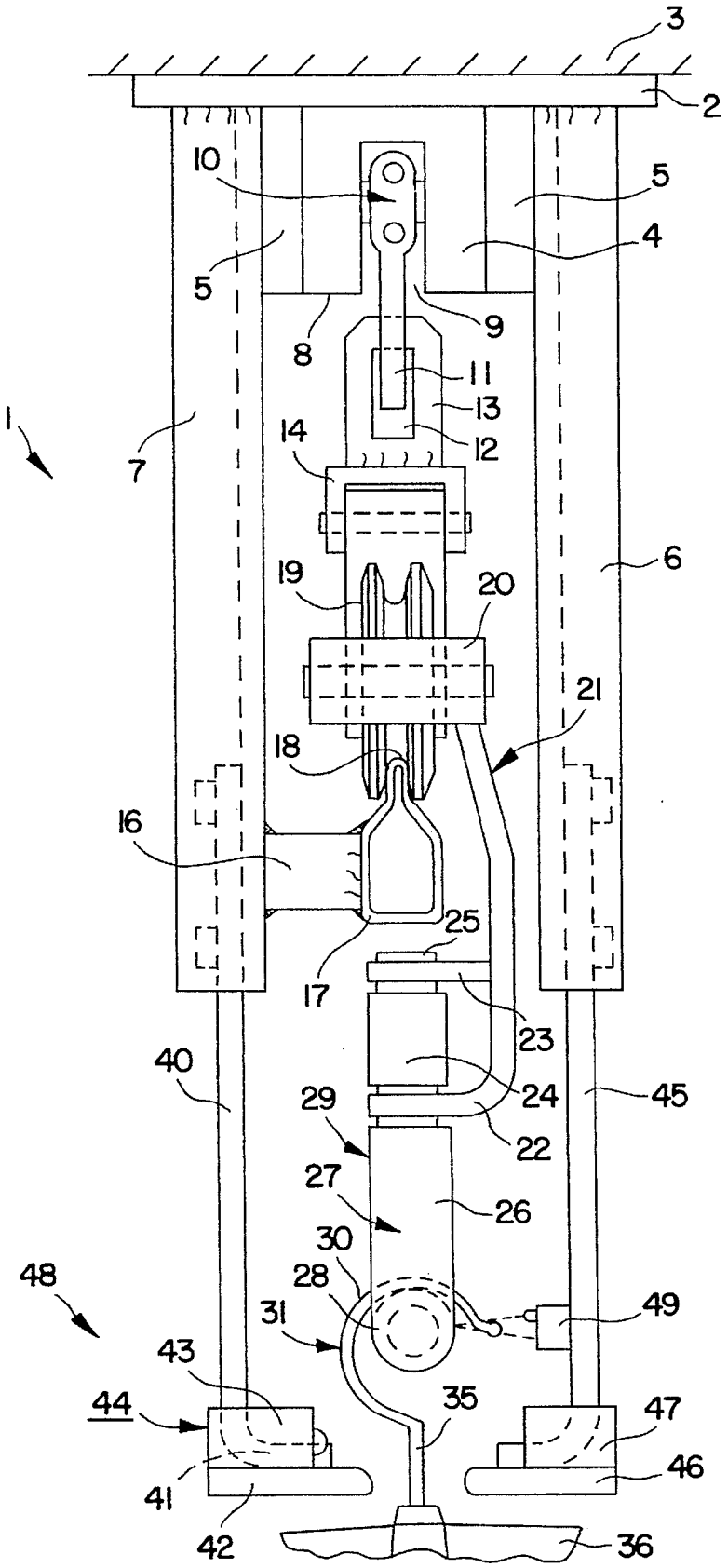
FIG. 2 is a side view of the hanging conveyor seen in the direction indicated by the arrow II in FIG. 1.

Referring initially to FIGS. 1 and 2, a hanging conveyor 1 is fastened to a ceiling 3 of a room at a number of fastening points via, in each case, a plate 2. A hollow section 4 with spacer plates 5, a right-hand holder 6, and a left-hand holder 7 are fastened to the plate 2, using bolts, for instance. The hollow section 4 has a cross section in the shape of a square tube and is made of sheet metal, a recess 9 being developed on its lower side 8. Within hollow section 4 there is a pull strand 10 supported on rollers which is developed in the manner of a chain and bears carrier arms bolted to it, one carrier arm 11 being shown in FIGS. 1 and 2. Pull strand 10 is endless and is guided over guide rollers one of which is connected for driving with a drive motor.

Each of the carrier arms 11 grips with its hook-shaped ends through a recess 12 in a strap 13 which is firmly welded onto one end of a U-shaped carrier 14. On the free end of carrier 14 there is firmly welded, in the same manner, a strap which corresponds to the strap 13, which in turn is connected in the manner described above with the end of another carrier arm which is fastened to the pull strand 10. Within the U-shaped carrier 14, drivers are arranged, one driver 15 being shown.

The arrangement of pull strand 10 in hollow section 4 is such that pull strand 10, carrier arms 11 fastened to it, and carriers 14 suspended therefrom are movable via the drive motor in or opposite to the direction indicated by the arrow R in FIG. 1.

The free end of the left-hand holder 7 has an extension 16 on which a rail 17 is fastened. The rail 17 is developed in a known manner as a hollow section of sheet metal, the upper, semicircular edge forming a travel path 18. On the semicircular edge of rail 17 is supported a correspondingly-shaped roller 19 which is rotatably received in a bearing 20. Bearing 20 is made of bar steel and extends around roller 19. The protruding structure assures contact between the driver 15 and the bearing 20.

In accordance with FIGS. 1 and 2, a lever 21 which, in addition to a bend, has a bent-off end 22 and a stem 23 and is supported on the bearing 10 on one side. Stem 23 and end 22 have aligned holes (not shown) which extend along an axis 24. The axis 24 extends centrally through the semicircular travel path 18 or centrally through the roller 19. A pin 25 is received in a rotatable manner and secured in an axial direction within the holes. Pin 25 terminates within one leg 26 of a U-shaped tube 27. In FIG. 1, tube 27 is shown merely with the leg 26 and a carrier tube 28 extending substantially parallel. The other side of the tube 27 which is not shown is developed in the same manner and again rests via a roller on the travel path 18 of rail 17. The parts described above, that is two rollers 19 with bearing 20 and tube 27 connected therewith form a carriage 29, which frequently is also referred to as a trolley.

On the carrier tube 28 there are hung hooks 30 of clothes hangers, hereinafter referred to as hangers 31, 32, 33 and 34, the hooks being bent in the shape of three-quarters of a circle. With the customary shape of such hangers 31, 32, 33, 34 a stem 35 extends in each case from the hook 30 to a transverse carrier 36 on which an article of clothing to be conveyed (not shown) is hung, which, however, is not absolutely necessary for the counting process which is still to be described.

As shown in FIG. 1, hanger 31 is in its vertically hanging, and therefore normal, position, hanger 32 is in a slightly obliquely hanging position, and hangers 33, 34 are in a position in which their stems 37 and 38 cross each other and thus form a point of intersection 39.

As can further be noted from FIGS. 1 and 2, on the left-hand holder 7 there is fastened an angle 40, which has a bent-off leg 41. Onto the lower side of bent-off leg 41, there is screwed a guide plate 42 which on its top side has fastened to it a light transmitter 43 of an optoelectronic sensor 44. Furthermore, an angle 45 corresponding to the angle 40 is firmly screwed to the right-hand holder 6, on which a guide plate 46 is fastened. The guide plates 42, 46 are so arranged that between their facing edges there is formed a slot of 4 to 5 centimeters through which the stems 35, etc. of the hangers 31 to 34 pass.

On guide plate 46 there is fastened a receiver 47, which is also a part of sensor 44. Receiver 47 and light transmitter 43 form a light barrier and are so positioned with respect to each other that light emitted by the light transmitter 43 can be noted in a defined manner, as will be further described below. With the arrangement of the sensor 44, a counting place 48 is formed on hanging conveyor 1.

On angle 45 there is arranged a light barrier 49 which is directed at tube 28, the light transmitter and the light receiver being arranged in a housing.

As can be noted from FIGS. 3, 4, 5 and 8, the sensor 44 has individual sensor parts 44*a*, 44*b*, 44*c*, and 44*d*.
In detail:

the sensor part 44*a* has a light-transmitting part 43*a* and a receiver 47*a*;

the sensor part 44*b* has a light-transmitting part 43*b* and a receiver 47*b*;

the sensor part 44*c* has a light-transmitting part 43*c* and a receiver 47*c*; and the sensor part 44*d* has a light-transmitting part 43*d* and a receiver 47*d*.

Figure 3:
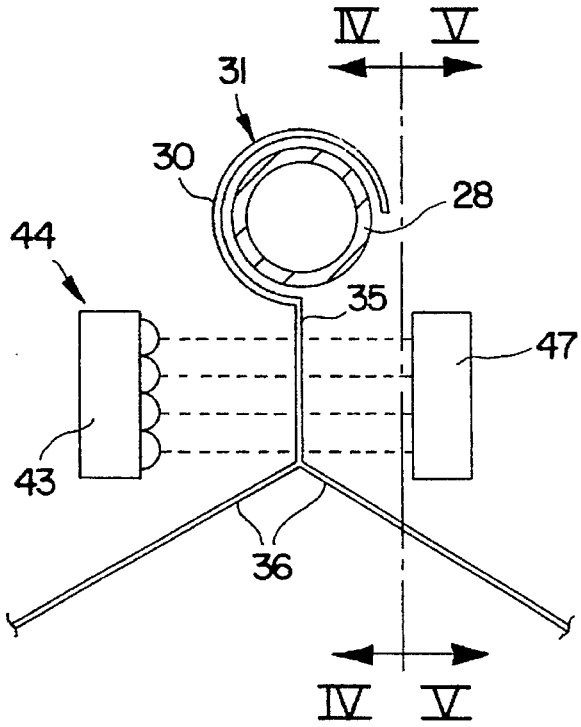
FIG. 3 is a sectional view on a larger scale corresponding to the section III—III of FIG. 1.
Figure 4:
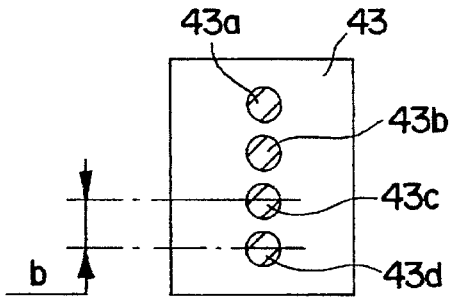
FIG. 4 is a sectional view on a larger scale corresponding to the section IV—IV of FIG. 3.
Figure 5:
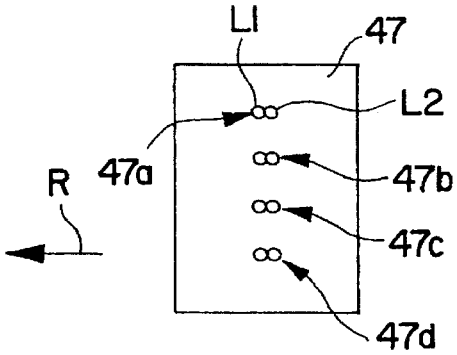
FIG. 5 is a sectional view on a larger scale corresponding to the section V—V of FIG. 3.
Figure 6:
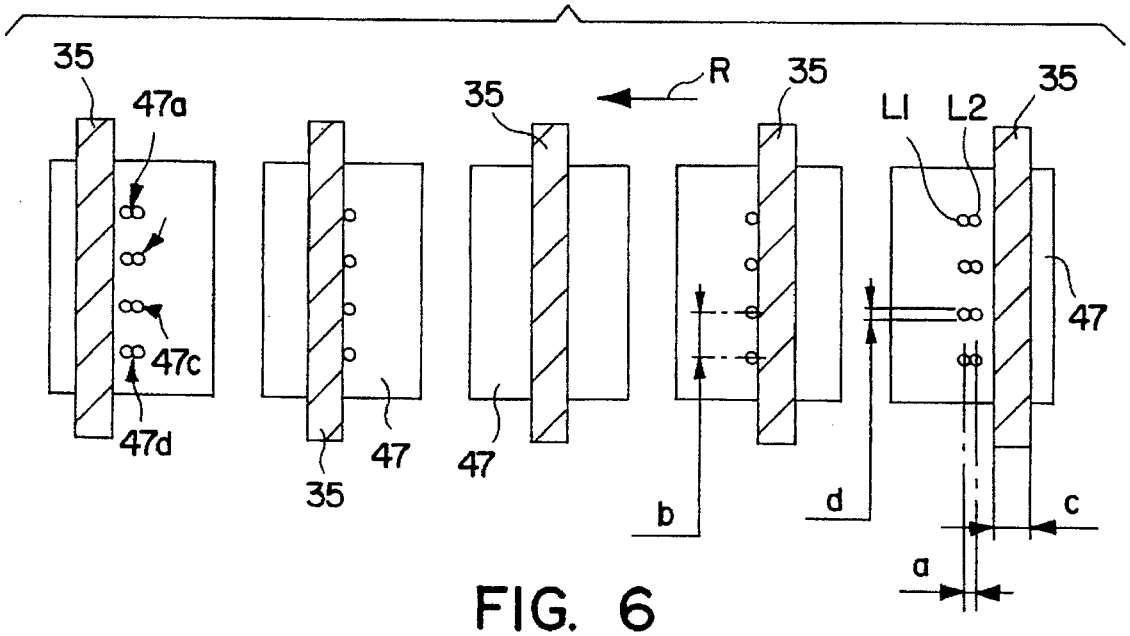
FIG. 6 Is a sequence of views in accordance with FIG. 5, with the article to be counted shown in the drawing.
Figure 7:
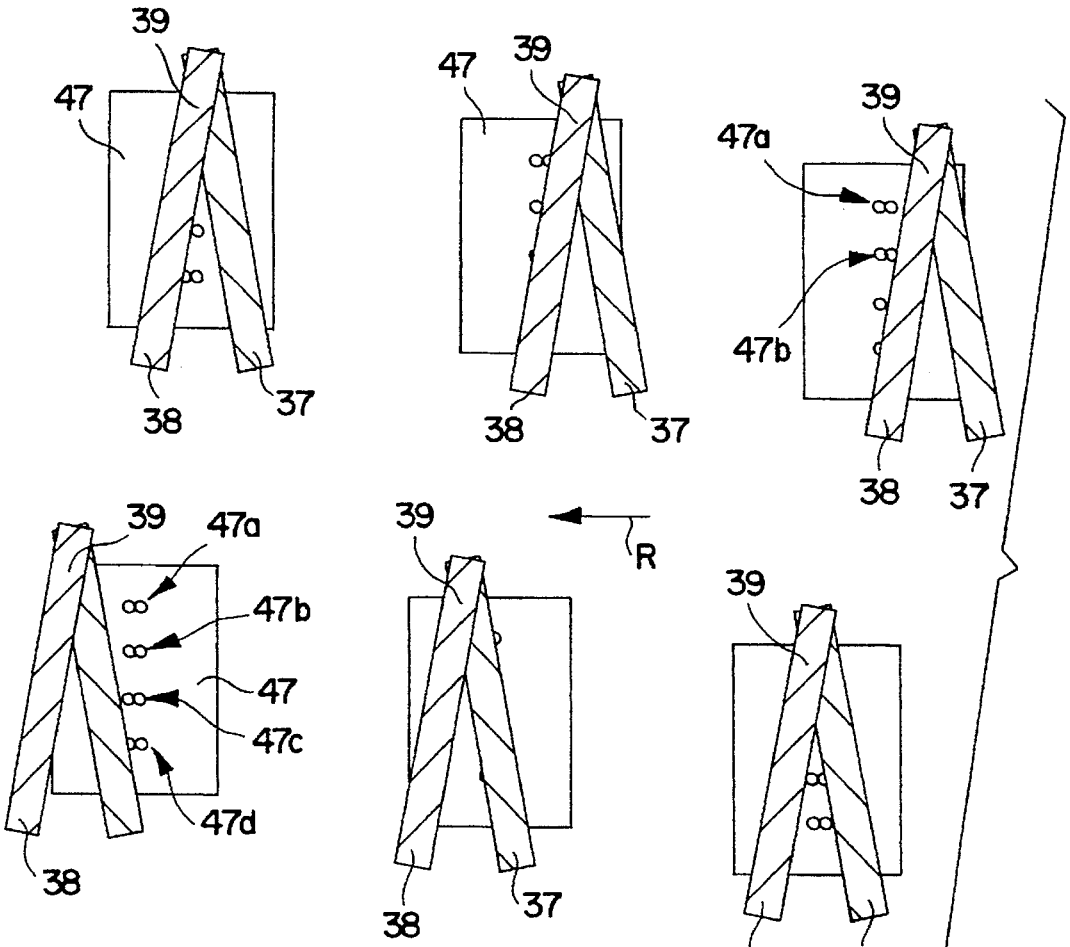
FIG. 7 is a sequence of views in accordance with FIG. 5, with articles to be counted shown being crossed.

The light-transmitting parts 43*a*, 43*b*, 43*c*, and 43*d* are arranged aligned with the receiver pairs 47*a*, 47*b*, 47*c*, and 47*d* in such a manner that in each case light spreads out between them over ray paths, as indicated by dashed connecting lines in FIG. 3.

Figure 8:
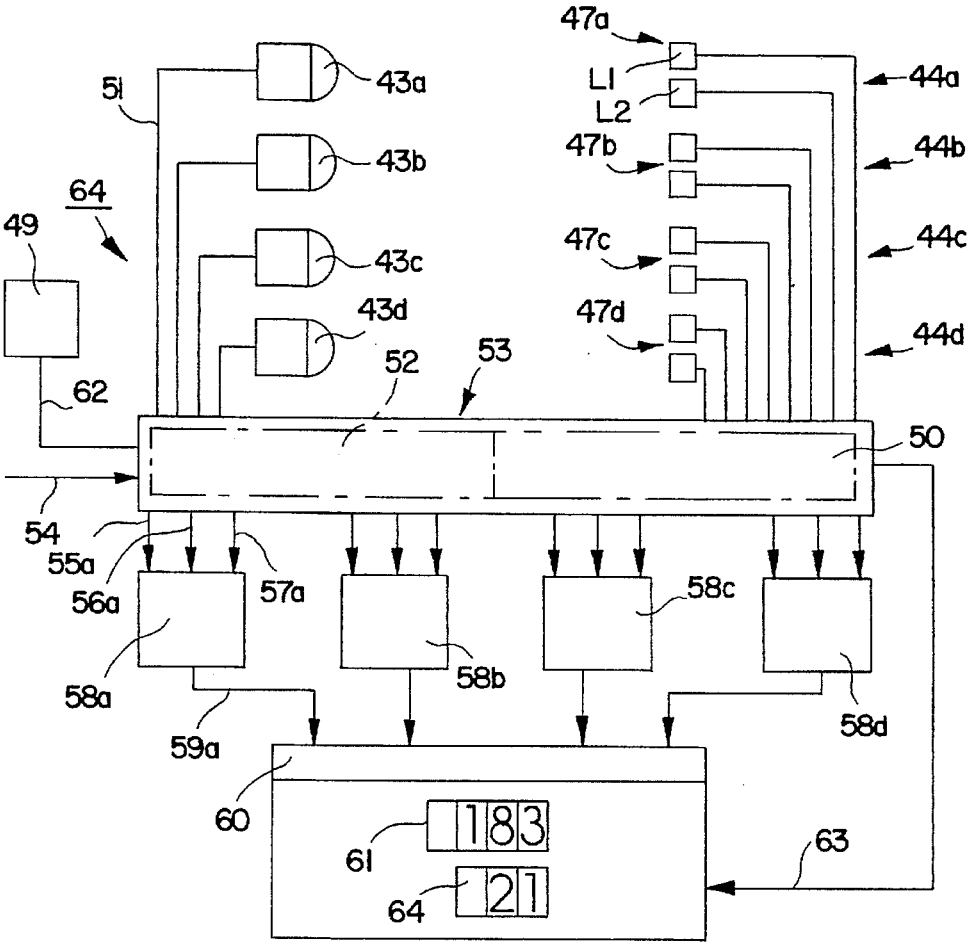
FIG. 8 is a block diagram of the counting device according to an embodiment of the present invention.

FIG. 8 shows a diagram of the connection of the sensor 44 with other structural parts. Since this connection is the same for all sensor parts 44*a* to 44*d*, the following description will be limited to the connection for the sensor part 44*a*. Accordingly, corresponding structural elements are designated in the same way with the suffix "*a*".

The sensor part 44*a* is developed on its receiver pair 47*a* with circular light guides L1 and L2, each of which is formed from light-conducting plastic and has a diameter d=1 millimeter. The light guides L1 and L2 conduct the light to the optoelectronic structural parts provided as sensors which are integrated in the electronic circuit and terminating with circular cross sections at the receiver pair 47*a*, the light guides being arranged directly alongside of each other in the direction of the arrow R with a center-to-center distance of a=1 millimeter. The free ends of the light guides L1 and L2 are connected via an optoelectronic interface with an evaluation circuit 50. The evaluation circuit 50 operates in accordance with an algorithm which will be described further below. In this connection, the evaluation circuit 50 can assume any one of the states Z0, Z1, Z2, Z3, Z4, Z5, and Z6, as shown diagrammatically in FIG. 9.

Light-transmitting parts 43*a*, 43*b*, 43*c*, and 43*d* are so dimensioned that they are able simultaneously to illuminate both light guides L1, L2 of the receiver pairs 47*a, b, c, d*. Light-transmitting part 43*a* is connected via a line 51 with a control circuit 52. The evaluation circuit 50 and the control circuit 52 form parts of an electronic control 53 for the light guides L1, L2. The control 53 is provided with a control line 54 and outgoing lines 55*a*, 56*a*, and 57*a* that are connected with a decimal counter. Lines 55*a* and 57*a* serve to increment or decrement the decimal counter 58*a* by the number 1. Line 56*a* serves for zeroing the decimal counter 58*a*, and the latter is connected via a line 59*a* to a selection circuit 60 which is connected to a four-digit decimal display 61. Display 61 is shown in FIG. 8 by way of example with a counter reading of 0183.

For the sake of completeness, it is pointed out that a digital counter 58*b* is associated with the sensor part 44*b;* a digital counter 58*c* is associated with the sensor part 44*c;* and a digital counter 58*d* is associated with the sensor part 44*d*.

As can be noted from FIGS. 3 to 8, the sensor parts 44*a* to 44*d* are arranged in all cases at the same distance apart b=5 millimeters from each other vertically.

Light barrier 49 is connected via a line 62 to control 53 which, in turn, is connected via a line 63 to a two-digit display 64. The latter is shown in FIG. 8 with a counter reading of 21. Finally, control 53 is also connected to a voltage supply. All parts related to sensor 44 and light barrier 49 form a counting device 65.

The manner of operation is as follows:

Beginning from an initial state in which:

evaluation circuit 50 assumes state Z0;

decimal counters 58*a*, 58*b*, 58*c* and 58*d* and decimal displays 61 and 64 have a count of zero;

hanging conveyor 1 is in a traveling state, the direction of transport corresponding to the direction of arrow R;

carriage 29 with hangers 31 to 34 to be conveyed is still in front of counting place 48; and control 53 is in an operating state so that light guides L1, L2 receive light and accordingly give off a low signal, hereinafter indicated as L. Accordingly, the evaluation circuit 50 receives the signals of light guides L1, L2 as LL. When light guides L1, L2 on the other hand are covered and receive no light, they give off in each case a high signal, hereinafter indicated as HH.

The operation of sensor parts 44*a* to 44*d* takes place from control circuit 52 in sequential fashion with high switch frequency. In other words, in each case only one of the four sensor parts 44*a* to 44*d* is activated for a short time, and therefore only one light-transmitting part is supplied with current and only the corresponding pair of light guides is monitored as to its states of operation. Thereupon, the next-following sensor part is activated, etc. This manner of operation excludes interaction between the sensor parts 44*a* to 44*d* which are arranged closely alongside each other. The manner of operation of light barriers arranged closely alongside of each other is known from Federal Republic of Germany 33 45 008 C2, the disclosure of which is incorporated herein by reference.

Upon carriage 29 entering into counting place 48, light barrier 49 detects carrier tube 28. Control 53 gives off the signal via line 63 to the two-digit decimal display 64, so that the number of carriages 29 which have passed by is displayed. With the further conveying of carriage 29 in the direction indicated by the arrow R, the normal, namely vertically hanging hangers 31 pass through counting place 48, in which case the relative positions shown in FIG. 6 and the corresponding operating states of light guides L1, L2 result sequentially. Upon the entrance of hangers 31 and 34, their stems may come into contact with guide plates 42, 46, so that a certain aligning of the hangers for the next-following counting is obtained.

In general, upon the passage of stem 35 of a hanger in or opposite to the direction of arrow R, each of light guides L1 and L2 changes its condition in the sequence L,H,L when stem 35 has a width c which corresponds at least to the diameter or width d of light guide L1 or L2. In the case of conditions in accordance with the example of the embodiment, the mathematical condition $a+d \leqq c$ must therefore be satisfied for the requirement that also both light guides can be completely covered.

Accordingly, upon movement of hanger 35 through counting place 38, different sequences of signals result on light guides L1, L2, namely:

upon movement in direction R, signals LL, LH, HH, HL, LL, and in the opposite direction, signals LL, HL, HH, LH, LL.

This is the reason why counting device 65 is able to indicate the direction for the hangers to be counted. These different sequences of signals are processed in accordance with the algorithm, as will be described below with reference to FIG. 9. With the covering of light guide L2 (FIG. 6) and the non-covering of light guide L1, the signals are determined as LH. This results in a change in the state of the evaluation circuit 50 from state Z0 to state Z1. This step towards reaching the next higher state is indicated symbolically in FIG. 9 by an arrow drawn with a straight line directed from Z0 to Z1. This arrow is designated PLH corresponding to the state of light guides L1, L2.

Thereupon, states of light guides L1, L2 corresponding to linearly shown arrows PHH, PHL, and PLL, cause changes in the state of evaluation circuit 50 through states Z2, Z3 and Z0. With the reaching of state Z0 in the manner described above, evaluation circuit 50 brings about an incrementing of decimal counter 58*a* by an amount of 1.

Conversely, a decrementing of decimal counter 58*a* by the number 1 takes place when a change in state of evaluation circuit 50 takes places through the sequence of states Z0, Z4, Z5, Z6, Z0. This sequence is represented accordingly but with linear arrows which are designated with small initial letters, pHL, pHH, pLH, pLL.

Figure 9:
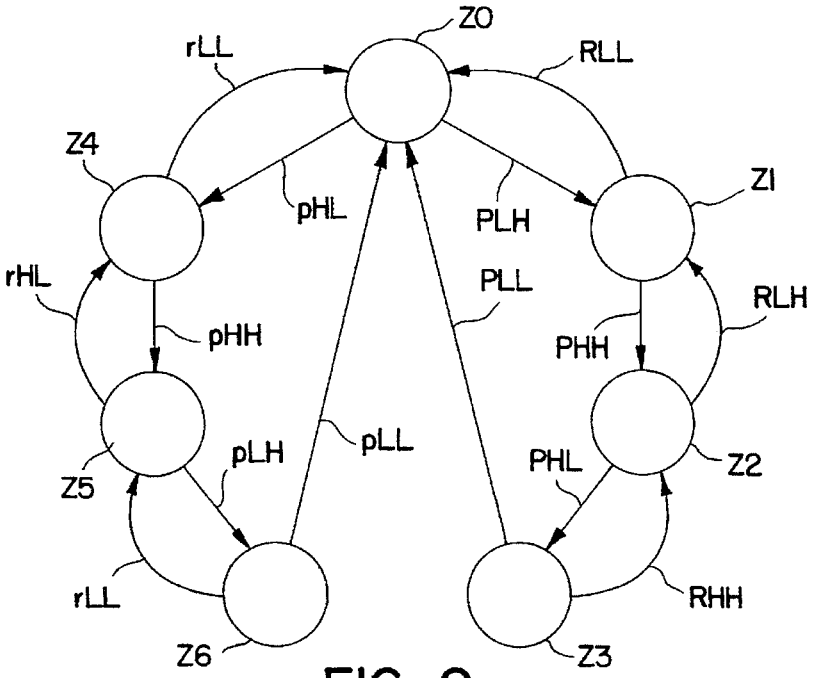
FIG. 9 is a diagrammatic showing of different conditions of an evaluation circuit according to an embodiment of the present invention.

In both sequences of states described, special circumstances may result in a change in the state to the next lower state. Such circumstances occur, for instance, when one of light guides L1 or L2, as a result of mechanical vibrations or unintended backward swinging of stem 35 to be counted again assumes its previous state of operation. Such processes are shown in FIG. 9 by arrows drawn in arc-shaped lines RLL, RLH, RHH, and rLL, rHL, rLL respectively. From the description of the algorithm, it results that counting device 65 permits a counting of carriages and hangers which pass by, regardless of the direction of movement and therefore in, or opposite to, the direction of arrow R.

The pulse given off, finally, by evaluation circuit 50 is fed to digital counter 58*a*. Similarly, the signals of other sensor parts 44*b*, 44*c* and 44*d* are processed, so that also corresponding digital counters 58*b*, 58*c* and 58*d* contain a counting result.

Upon the further conveying of carriage 29 in direction R, hangers 32, 33 and 34 also pass through counting place 48. Accordingly, the counting of hanger 32 proceeds normally, according to the process described above.

On the other hand, detecting and counting of crossed hangers 33, 34 takes place as follows: Point of intersection 39 of stems 37, 38 is detected as a single part, which causes an erroneous measurement reduced by 1. Such an erroneous measurement can occur on one or more of the sensor parts 44*a* to 44*d*, depending on the operating states. In particular, referring to FIG. 7, two upper receiver pairs 47*a*, 47*b* of sensor parts 44*a*, 44*b* detect intersection point 39 as a single hanger, while receiver pairs 47*c*, 47*d* recognize two hangers.

After a signal has been given over line 54 to control 50, the counting process is terminated. For this, the counted values totaled in decimal counters 58*a*, 58*b*, 58*c*, 58*d* are forwarded to selection circuit 60, which causes transmission of the maximum counted values from the counted values fed corresponding to this embodiment to decimal display 61.

Thereupon, the result of counting device 65 can be detected by reading the counter readings on decimal displays 61, 64 or forwarded to a central data processing unit. After the taking over of the counting result, all the counters concerned are reset to a value of zero by the sending of a corresponding pulse.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A device for counting articles hanging on hangers having stems, each stem having a width, the articles being conveyed along a conveying path, the device comprising:

a light barrier including at least two receivers aligned vertically and disposed in a plane substantially parallel to the conveying path, each of the receivers including two sensors for generating signals, the two sensors being disposed next to each other along the conveying direction and operating independently of each other, each of the two sensors having a center and a width, a sum of a center-to-center distance between the centers of the sensors plus the width of one of the sensors being less than or equal to the width of the stem of each hanger; and a counting and evaluation unit connected to the light barrier for counting and evaluating signals received from the sensors.

2. The device of claim 1, wherein the light barrier further comprises at least two light sources, each light source transmitting light to one of the at least two receivers.

3. The device of claim 1, further comprising hangers for holding the articles being conveyed along the conveying path, each hanger including a stem having a width.

4. The device of claim 1, wherein two crossed hangers overlap in an area having a height, and the receivers are spaced apart vertically such that a vertical distance between the receivers is greater the height.

5. The device of claim 4, further comprising hangers for holding the articles being conveyed along the conveying path, each hanger including a stem having a width.

6. The device of claim 1, wherein the light barrier further comprises light guides for conducting light to the sensors.

7. The device of claim 1, wherein the light barrier comprises four receivers vertically aligned.

8. The device of claim 1, wherein the counting and evaluating unit evaluates signals received from the sensors for determining a direction of transport of the articles conveyed.

9. The device of claim 1, wherein the hangers are carried on carriages, the device further comprising a second light barrier connected with the counting and evaluation unit for detecting and counting the carriages.

10. A device comprising:

a conveyor for conveying hanging articles along a conveying path;

hangers having stems, each stem having a width, an upper region, and a lower region, for holding the hanging articles to be conveyed by the conveyor;

a light barrier arranged on the conveyor for detecting the hangers and including at least two receivers aligned vertically and disposed in a plane substantially parallel to the conveying path, each of the receivers including two sensors for detecting the hangers and generating signals, the two sensors being disposed next to each other along the conveying direction and operating independently of each other, each of the two sensors having a center and a width, a sum of a center-to-center distance between the centers of the sensors plus the width of one of the sensors being less than or equal to the width of the stem of the hanger; and a counting and evaluation unit connected to the light barrier for counting and evaluating signals received from the sensors.

11. The device of claim 10, wherein the light barrier further comprises at least two light sources, each light source transmitting light to one of the at least two receivers.

12. The device of claim 10, wherein two crossed hangers overlap in an area having a height, and the receivers are spaced apart vertically such that the vertical distance between the receivers is greater the height.

13. The device of claim 10, wherein the light barrier further comprises light guides for conducting light to the sensors.

14. The device of claim 10, wherein the light barrier comprises four receivers vertically aligned.

15. The device of claim 10, wherein the counting and evaluating unit evaluates signals received from the sensors for determining a direction of transport of the articles conveyed on the conveyor.

16. The device of claim 10, wherein the conveyor further comprises carriages for carrying the hangers, the device further comprising a second light barrier connected with the counting and evaluation unit for detecting and counting the carriages.

17. A device for counting articles hanging on hangers having stems, each stem having a width, the articles being conveyed along a conveying path, the device comprising a light barrier including at least two receivers aligned vertically and disposed in a plane substantially parallel to the conveying path, each of the receivers including two sensors for generating signals, the two sensors being disposed next to each other along the conveying direction and operating independently of each other, each of the two sensors having a center and a width, a sum of a center-to-center distance between the centers of the sensors plus the width of each sensor being less than or equal to the width of the stem of each hanger.

18. The device of claim 17, wherein the light barrier further comprises at least two light sources, each light source transmitting light to one of the at least two receivers.

19. The device of claim 17, wherein the light barrier further comprises light guides for conducting light to the sensors.

20. The device of claim 17, wherein the light barrier comprises four receivers vertically aligned.

* * * * *